US008291869B2

(12) United States Patent
Min

(10) Patent No.: US 8,291,869 B2
(45) Date of Patent: Oct. 23, 2012

(54) METHOD FOR PREVENTING COAGULATION IN EXHAUST PIPE OF BOILER

(75) Inventor: Tae Sik Min, Seoul (KR)

(73) Assignee: Kyungdong Navien Co., Ltd., Pyeongtaek-Si (KR)

( * ) Notice: Subject to any disclaimer, the term of this patent is extended or adjusted under 35 U.S.C. 154(b) by 861 days.

(21) Appl. No.: 12/445,731

(22) PCT Filed: Oct. 17, 2007

(86) PCT No.: PCT/KR2007/005091

§ 371 (c)(1),
(2), (4) Date: Apr. 15, 2009

(87) PCT Pub. No.: WO2008/048048

PCT Pub. Date: Apr. 24, 2008

(65) Prior Publication Data

US 2010/0307735 A1 Dec. 9, 2010

(30) Foreign Application Priority Data

Oct. 17, 2006 (KR) ..... 10-2006-0100753

(51) Int. Cl.
*F22B 7/00* (2006.01)

(52) U.S. Cl. ..... 122/155.1; 122/155.2; 122/18.1; 237/2 R; 237/8 R; 237/9 R; 237/81

(58) Field of Classification Search ..... 122/18.1, 122/155.1, 155.2; 237/2 R, 2 A, 8 R, 8 A, 237/8 B, 8 C, 8 D, 9 R, 12, 81
See application file for complete search history.

(56) References Cited

U.S. PATENT DOCUMENTS

| | | | | | |
|---|---|---|---|---|---|
| 404,927 | A * | 6/1889 | McElroy | 137/590 |
| 2,529,915 | A * | 11/1950 | Chausson | 237/12.3 A |
| 3,896,992 | A * | 7/1975 | Borovina et al. | 237/19 |
| 4,154,225 | A * | 5/1979 | Maher | 126/374.1 |
| 4,178,907 | A * | 12/1979 | Sweat, Jr. | 261/39.1 |
| 4,557,220 | A * | 12/1985 | Jannemann et al. | 122/20 B |
| 4,599,992 | A * | 7/1986 | Harding | 237/8 A |
| 5,129,387 | A | 7/1992 | Behrens | |
| 5,411,013 | A * | 5/1995 | Kazen | 126/307 R |
| 6,283,067 | B1 * | 9/2001 | Akkala | 122/14.22 |

(Continued)

FOREIGN PATENT DOCUMENTS

JP 11-226348 8/1999

(Continued)

*Primary Examiner* — John K Fristoe, Jr.
*Assistant Examiner* — Minh Le
(74) *Attorney, Agent, or Firm* — Hershkovitz & Associates, LLC; Abraham Hershkovitz

(57) ABSTRACT

A method and an apparatus are provided for preventing coagulation in an exhaust pipe of a boiler is provided. The method includes operating the boiler and executing a combustion stroke, determining if an ambient air temperature measured by an ambient air temperature detecting sensor is equal to or lower than a first temperature, shifting a 3-way valve to a hot-water location if the measured ambient air temperature is equal to or lower than the first temperature, executing an extinction stroke of a burner if the temperature of space heating water reaches a second temperature, and operating a circulation pump and a blower to exchange heat in a heat exchanger and to discharge warm air through an exhaust pipe, thereby preventing coagulation in the exhaust pipe of the boiler.

7 Claims, 3 Drawing Sheets

U.S. PATENT DOCUMENTS

| | | | | |
|---|---|---|---|---|
| 6,415,744 | B1 * | 7/2002 | Choi | 122/18.1 |
| 6,694,926 | B2 * | 2/2004 | Baese et al. | 122/14.2 |
| 7,322,532 | B2 * | 1/2008 | Takada et al. | 236/11 |
| 7,380,588 | B2 * | 6/2008 | Helt | 165/240 |
| 7,597,066 | B2 * | 10/2009 | Shimada et al. | 122/18.1 |
| 7,628,123 | B2 * | 12/2009 | Inami et al. | 122/448.3 |
| 7,824,177 | B2 * | 11/2010 | Takasu et al. | 431/29 |
| 8,042,495 | B2 * | 10/2011 | Min | 122/18.1 |
| 2004/0118932 | A1 * | 6/2004 | Sanchez | 237/2 A |
| 2007/0084420 | A1 * | 4/2007 | Boros et al. | 122/18.1 |
| 2007/0205308 | A1 * | 9/2007 | Nishida | 239/547 |
| 2008/0156281 | A1 * | 7/2008 | Kim | 122/14.3 |
| 2009/0133641 | A1 * | 5/2009 | Min | 122/14.3 |
| 2010/0316963 | A1 * | 12/2010 | Kim | 431/12 |

FOREIGN PATENT DOCUMENTS

| | | |
|---|---|---|
| JP | 2003-185269 | 7/2003 |
| KR | 10-1999-0053120 | 7/1999 |

* cited by examiner

METHOD FOR PREVENTING COAGULATION IN EXHAUST PIPE OF BOILER

RELATED APPLICATIONS

This is an U.S. National Phase Patent Application Under 35 USC §371 of International Patent Application No. PCT/KR2007/005091, filed on Oct. 17, 2007, which claims priority of Korean Patent Application No. 10-2006-0100753, filed on Oct. 17, 2006.

BACKGROUND OF THE IVENTION

1. Field of the Invention

The present invention relates to a method for preventing coagulation of steam in an exhaust pipe of a boiler, and more particularly to a method for preventing coagulation in an exhaust pipe of a proportional control boiler, in which, when an ambient air temperature is equal to or lower than a predetermined temperature, the temperature of space heating pipe water is raised and a blower is then rotated to discharge warm air through the exhaust pipe, thereby preventing coagulation of steam and creation of icicles at an end portion of the exhaust pipe of the boiler.

2. Discussion of Background Information

FIG. 1 is a schematic view illustrating an exhaust structure of a conventional boiler.

In the conventional boiler, ambient air introduced through an air supply pipe 10 is supplied to a burner 30 together with fuel by means of a blower 20, and exhaust gas generated due to the combustion in the burner 30 is heat-exchanged with space heating water transferred by a circulation pump 50 in a main heat exchanger 40, and then the heat-exchanged exhaust gas is discharged to an outside of the boiler, i.e., to the air, through an exhaust pipe 60.

The exhaust gas includes a substantial amount of $H_2O$, and the temperature of the exhaust gas is generally equal to or higher than 100° C., so that moisture contained in the exhaust gas is discharged to the outside in a state of steam without being condensed through the exhaust pipe.

However, when the temperature of ambient air is very low, such as in the winter, a case occurs where the temperature of the end portion of the exhaust pipe drops low enough to reach or fall below a dew point temperature to which the steam contained in the exhaust gas starts to be condensed, and is generally 40° C. to 55° C. In this case, the steam is condensed at the end portion of the exhaust pipe.

Further, in this case, when the temperature of ambient air is below zero, the steam condensed at the end portion of the exhaust pipe freezes to form icicles. The icicles hanging from the exhaust pipe not only are unseemly but also may cause damage to lives and properties if the icicles fall from an upper floor of a tall building.

Conventionally, a method for raising the temperature of the exhaust gas in order to prevent creation of icicles at the end portion of the exhaust pipe and a method for insulating an outside of the exhaust pipe in order to prevent a drop in temperature of the end portion of the exhaust pipe have been proposed.

Here, the temperature of the exhaust gas is related to the efficiency of the boiler. As such, in order to raise the temperature of the exhaust gas as proposed by the conventional method for preventing creation of icicles at the end portion of the exhaust pipe, it is inevitable to lower the efficiency of the boiler, thereby resulting in a waste of energy.

Further, in order to insulate the outside of the exhaust pipe, the conventional method requires a complex structure and higher cost due to the use of insulating materials.

Therefore, the present invention has been made in view of the above-mentioned problems, and it is an object of the present invention to provide a method for preventing coagulation in an exhaust pipe of a boiler, in which, when ambient air temperature is equal to or lower than a predetermined temperature, the temperature of the space heating pipe water is raised and a blower is then rotated to discharge warm air through the exhaust pipe, thereby preventing coagulation of steam and creation of icicles at an end portion of the exhaust pipe of the boiler.

SUMMARY OF THE INVENTION

To accomplish the above objects, there is provided a method for preventing coagulation in an exhaust pipe of a boiler. The method includes: operating the boiler to execute a combustion stroke; determining if an ambient air temperature measured by an ambient air temperature detecting sensor is equal to or lower than a first temperature; shifting a 3-way valve to a hot-water location if the measured ambient air temperature is equal to or lower than the first temperature; executing an extinction stroke of a burner if the temperature of space heating water reaches a second temperature; and operating a circulation pump and a blower to exchange heat in a heat exchanger to discharge warm air through an exhaust pipe.

In an embodiment of the invention, the space heating water can be circulated through a closed circuit by operation of the circulation pump when the 3-way valve is shifted to the hot-water location, the closed circuit including the circulation pump, the heat exchanger, the 3-way valve, a hot water heat exchanger, and an expansion tank.

Further, in an embodiment of the invention, the second temperature of the space heating water for executing the extinction stroke of the burner is a maximum temperature attainable in the closed circuit when the 3-way valve is shifted to the hot-water location.

As described above, according to the method for preventing coagulation in the exhaust pipe of the boiler of the present invention, the temperature of space heating pipe water can be raised and the blower is rotated to discharge warm air through the exhaust pipe, thereby preventing coagulation of and creation of icicles at an end portion of the exhaust pipe of the boiler. Further, this can prevent damage to lives and properties caused by falling icicles.

DETAILED DESCRIPTION OF EMBODIMENTS

Figure 1:
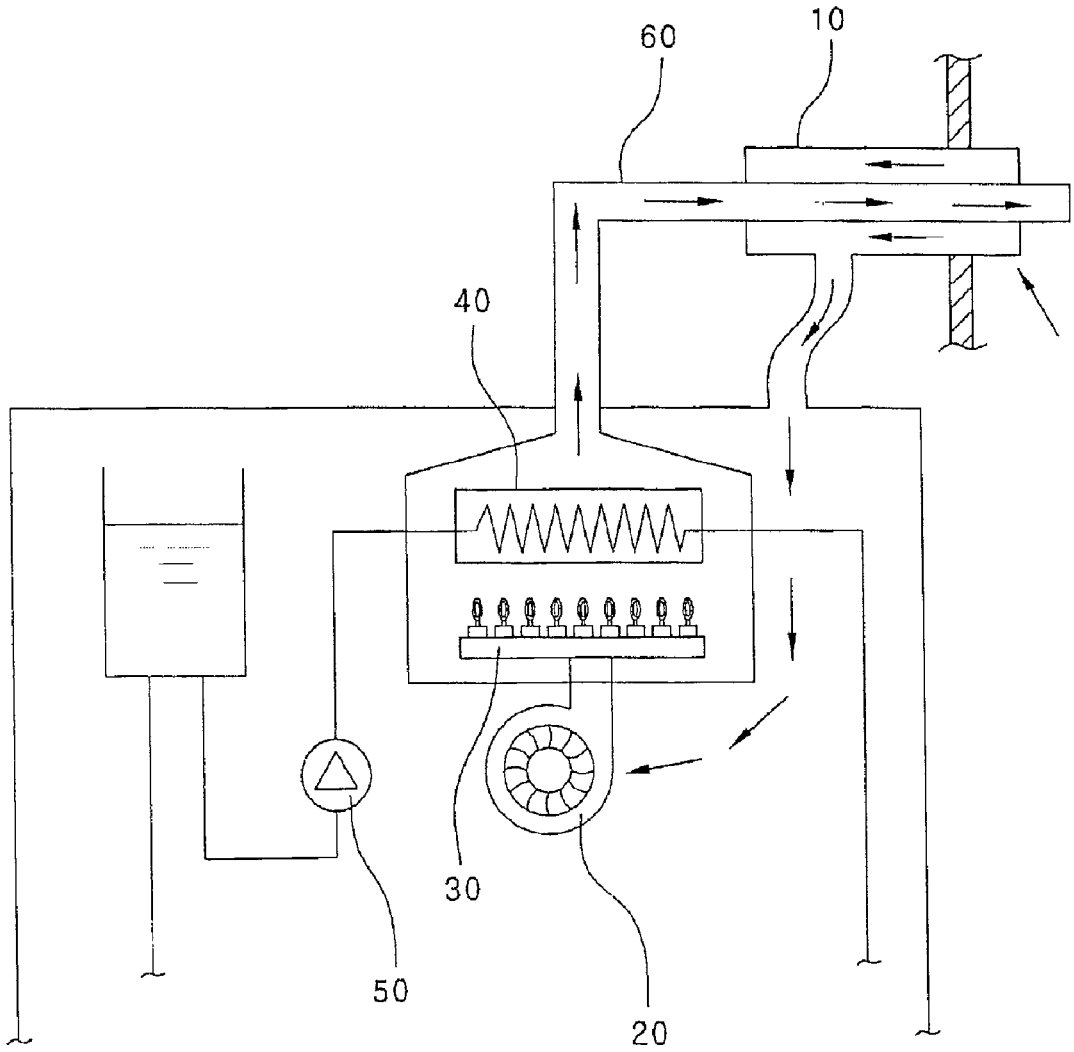
FIG. 1 (PRIOR ART)
FIG. 1 is a prior art schematic view illustrating an exhaust structure of a conventional boiler.

Hereinafter, a preferred embodiment of the present invention will be described with reference to the accompanying drawings. In the following description and drawings, the same reference numerals are used to designate the same or similar components, and so repetition of the description on the same or similar components will be omitted.

Figure 2:
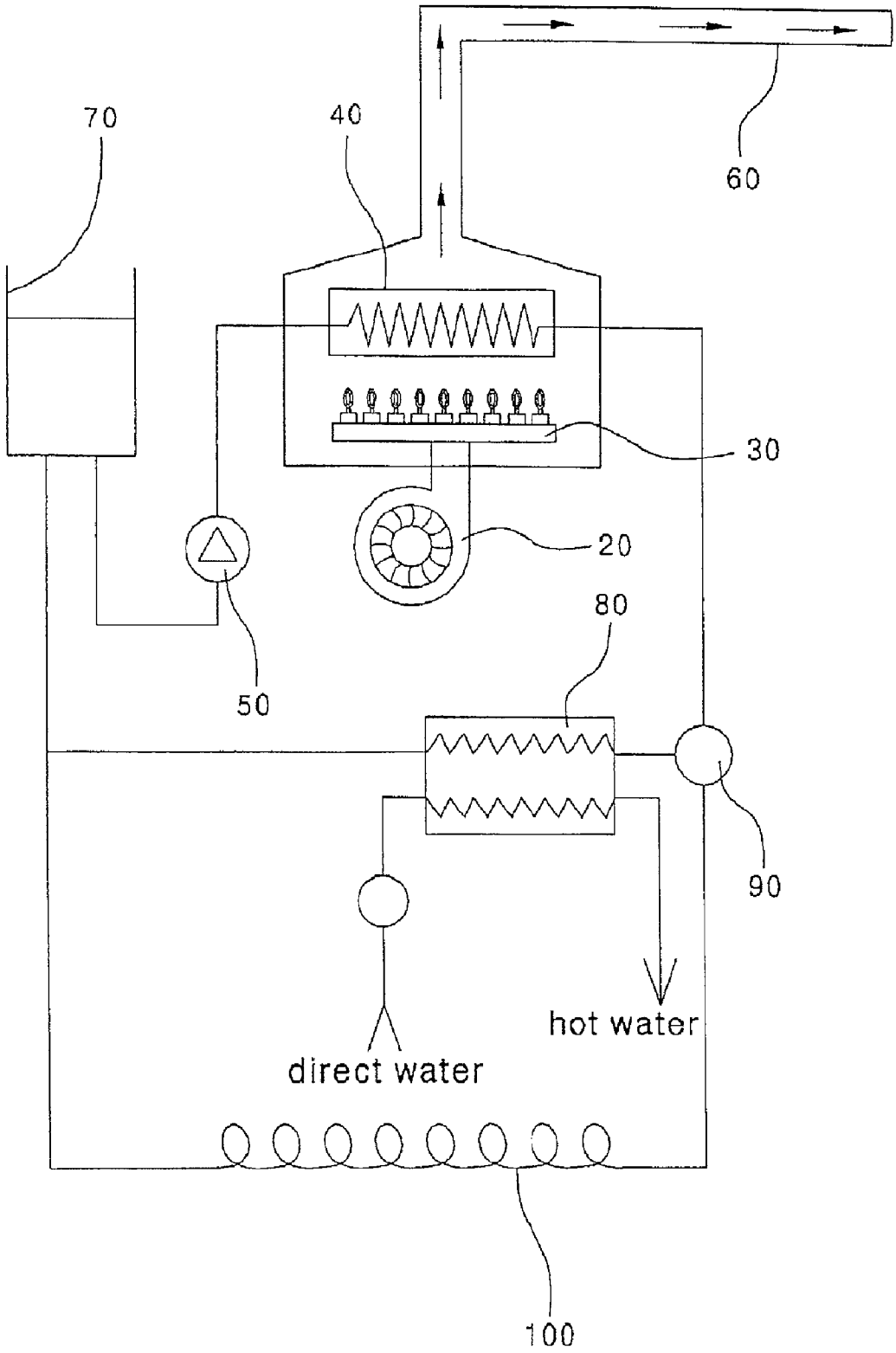
FIG. 2 is a schematic view illustrating a structure of a boiler employing a method for preventing coagulation according to an embodiment of the present invention.
Figure 3:
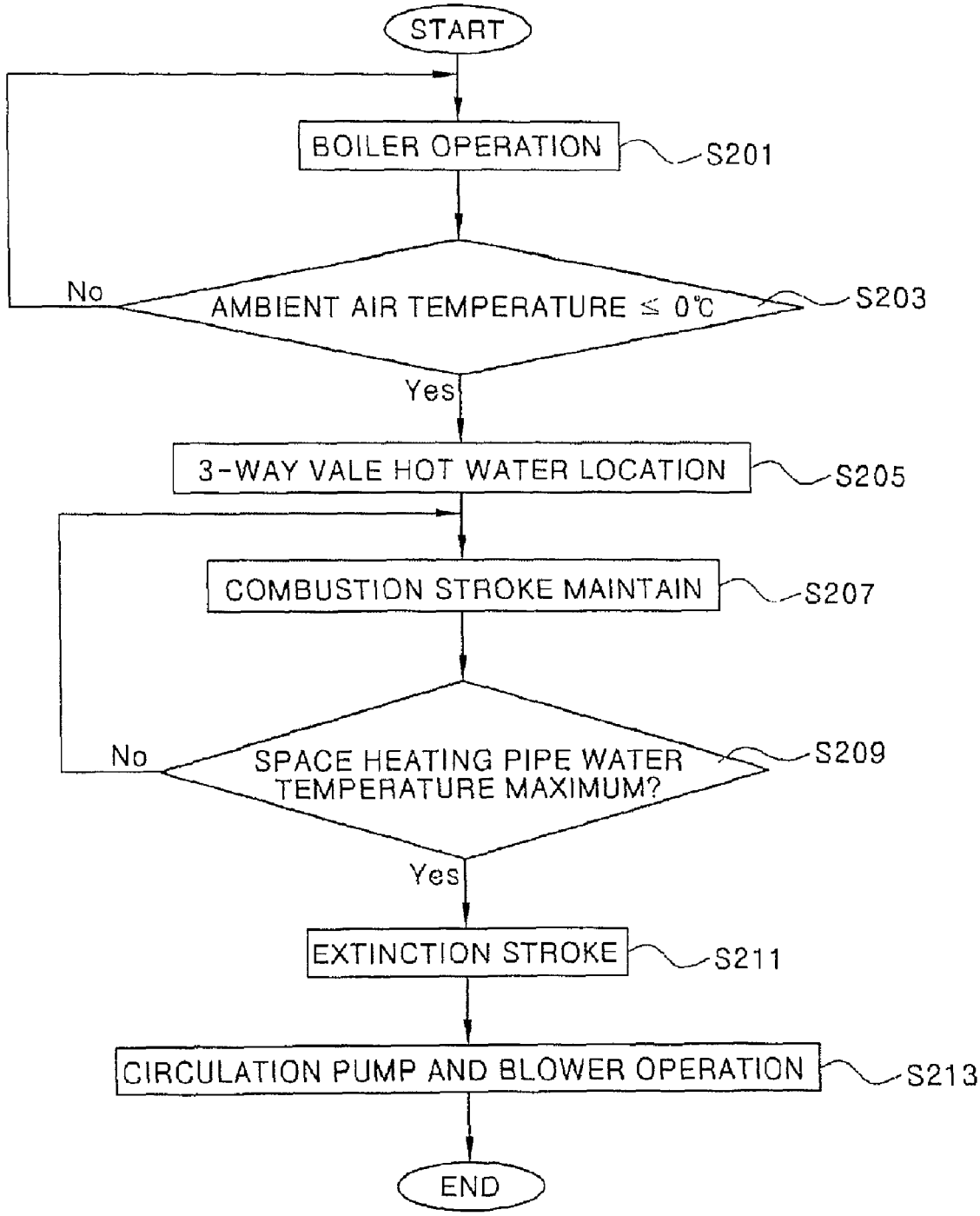
FIG. 3 is a flowchart illustrating the method for preventing coagulation according to the embodiment of the present invention.

FIG. 2 is a schematic view illustrating a structure of a boiler employing a method for preventing coagulation according to an embodiment of the present invention, and FIG. 3 is a flowchart illustrating the method for preventing coagulation according to the embodiment of the present invention.

In order to implement a control method according to the present invention, an ambient air temperature detecting sensor (not shown) can be mounted outdoors or in an inlet of an air supply blower 20 of the boiler to detect the ambient air temperature.

First, the boiler is operated so as to execute a combustion stroke S201. In this case, an operation mode can include both a heating mode and a hot-water mode.

If the ambient air detected by the ambient air temperature detecting sensor reaches 0° C., at which water condensed at an end portion of an exhaust pipe 60 freezes S203, a controller shifts a 3-way valve 90 to a hot-water location, so as to prevent space heating water from being introduced into a space heating pipe 100, in which heat exchange is executed with a floor of a room, and to direct the space heating water to flow into a hot water heat exchanger 80 S205. In this case, the combustion stroke executed in the burner 30 maintains its state S207.

At this time, the space heating water can be circulated by an operation of the circulation pump 50 through a closed circuit including a circulation pump 50, a main heat exchanger 40, the 3-way valve 90, the hot water heat exchanger 80, and an expansion tank 70. Further, the present invention can include a fluid channel structure in which the space heating water inevitably passes through the expansion tank 70.

The expansion tank 70 can generally store 4 to 8 liters of space heating water. Further, if the combustion occurs in a state where the 3-way valve 90 is shifted to the hot-water location, the space heating water circulating in the closed circuit is heated so that the expansion tank 70 accumulates heat energy which can prevent the end portion of the exhaust gas from freezing.

A heating water temperature measuring sensor (not shown) senses the temperature of the space heating water flowing in the pipe, and the controller determines if the measured temperature of the space heating water reaches a predetermined temperature S209. If the measured temperature of the space heating water reaches the predetermined temperature, the controller determines that the measured temperature can prevent the end portion of the exhaust pipe from freezing so as to execute an extinction stroke S211.

Here, the predetermined temperature of the space heating water for the extinction stroke of the burner 30 can be a maximum temperature attainable in the heating water-circulating closed circuit including the expansion tank 70 in a state where the 3-way valve 90 is shifted to the hot-water location. In general, it is possible to raise the temperature of the space heating pipe water inside of the boiler up to 80 to 85° C.

However, if the fluid channel structure, in which the space heating water circulates, is specified, the maximum temperature can be determined by an experiment.

If the extinction stroke is executed, the circulation pump 50 and the blower 20 are operated, and air transferred by the blower 20 is heat exchanged with the space heating water heated through the above steps in the main heat exchanger 40. Thus, the heat-exchanged air will become relatively warm. When discharged to the outside, the relatively warm air is in contact with the steam or condensed water at the end portion of the exhaust pipe 60 to prevent the water from freezing.

While this invention has been described in connection with what is presented considered to be the most practical and preferred embodiment, it is to be understood that the invention is not limited to the disclosed embodiment and the drawings, but, on the contrary, it is intended to cover various modifications and variations within the spirit and scope of the appended claims.

As described above, the method according to the present invention can prevent the coagulation of steam and creation of icicles at an end portion of the exhaust pipe of the boiler if the ambient air temperature is equal to or lower than a predetermined temperature.

The invention claimed is:

1. A method for preventing coagulation in an exhaust pipe of a boiler, the method comprising:

operating the boiler to execute a combustion stroke;

determining if an ambient air temperature measured by an ambient air temperature detecting sensor is equal to or lower than a first temperature;

shifting a 3-way valve to a hot-water location if the measured ambient air temperature is equal to or lower than the first temperature;

executing an extinction stroke of a burner if the temperature of space heating water reaches a second temperature; and operating a circulation pump and a blower to exchange heat in a heat exchanger to discharge warm air through an exhaust pipe.

2. The method according to claim 1, wherein the space heating water is circulated through a closed circuit by operation of the circulation pump when the 3-way valve is shifted to the hot-water location, the closed circuit including the circulation pump, the heat exchanger, the 3-way valve, a hot water heat exchanger, and an expansion tank.

3. The method according to claim 2, wherein the second temperature of the space heating water for executing the extinction stroke of the burner is a maximum temperature attainable in the closed circuit when the 3-way valve is shifted to the hot-water location.

4. The method according to claim 1, wherein the space heating water is circulated by operation of the circulation pump through a closed circuit including the circulation pump, and the second temperature of the space heating water for executing the extinction stroke of the burner is a maximum temperature attainable in the closed circuit in a state where the 3-way valve is shifted to the hot-water location.

5. A method for preventing coagulation in an exhaust pipe of a boiler, the method comprising:

operating the boiler to execute a combustion stroke;

determining if an ambient air temperature measured by an ambient air temperature detecting sensor is equal to or lower than a first temperature;

shifting a 3-way valve to a hot-water location if the measured ambient air temperature is equal to or lower than the first temperature;

executing an extinction stroke of a burner if the temperature of space heating water reaches a second temperature; and operating a circulation pump and a blower to exchange heat in a heat exchanger to discharge warm air through an exhaust pipe, wherein the space heating water is circulated through a closed circuit by operation of the circulation pump when the 3-way valve is shifted to the hot-water location, the closed circuit including the circulation pump, the heat exchanger, the 3-way valve, a hot water heat exchanger, and an expansion tank, and wherein the second temperature of the space heating water for executing the extinction stroke of the burner is a maximum temperature attainable in the closed circuit in a state where the 3-way valve is shifted to the hot-water location.

6. An apparatus for preventing coagulation in an exhaust pipe of a boiler, the apparatus comprising:

a heat exchanger configured to transmit heat from a heating device to inflow water to supply heated water;

a 3-way valve configured to shift to a hot-water location if a measured ambient air temperature is equal to or lower than a predetermined temperature;

a circulation pump configured to circulate space heating water through a closed circuit when the 3-way valve is shifted to the hot-water location, the closed circuit including the circulation pump, the heat exchanger, the 3-way valve, a hot water heat exchanger, and an expansion tank; and the expansion tank configured to store the space heating water.

7. The apparatus according to claim 6, wherein an extinction stroke of a burner is executed if a temperature of the space heating water reaches a maximum temperature attainable in the closed circuit in a state where the 3-way valve is shifted to the hot-water location.

* * * * *